US006066421A

United States Patent [19]

Julien et al.

[11] Patent Number: 6,066,421

[45] Date of Patent: May 23, 2000

[54] COLOR TONER COMPOSITIONS AND PROCESSES THEREOF

[76] Inventors: Paul C. Julien, 23 Leedale Dr., Webster, N.Y. 14580; Susan J. Kremer, 27 Burley Rd., Rochester, N.Y. 14612; Yelena Shapiro, 64 Werner Park, Rochester, N.Y. 14620; Elliott A. Eklund, 34 Jackson Rd. Ext.; Sue E. Blaszak, 1 Olde Prestwick Way, both of Penfield, N.Y. 14526; Edul N. Dalal, 5 Mount View Crescent, Webster, N.Y. 14580

[21] Appl. No.: 09/178,158

[22] Filed: Oct. 23, 1998

[51] Int. Cl.[7] ..... G03G 9/09

[52] U.S. Cl. ..... 430/45; 399/266

[58] Field of Search ..... 430/45, 47; 399/266

[56] References Cited

U.S. PATENT DOCUMENTS

| | | | |
|---|---|---|---|
| 5,204,208 | 4/1993 | Paine et al. | 430/137 |
| 5,391,456 | 2/1995 | Patel et al. | 430/137 |
| 5,557,393 | 9/1996 | Goodman et al. | 355/326 R |
| 5,688,626 | 11/1997 | Patel et al. | 430/137 |
| 5,713,062 | 1/1998 | Goodman et al. | 399/49 |
| 5,899,608 | 5/1999 | Eklund et al. | 399/266 |

FOREIGN PATENT DOCUMENTS 0 620 505 A1 10/1994 European Pat. Off. .

*Primary Examiner*—John Goodrow
*Attorney, Agent, or Firm*—John L. Haack

[57] ABSTRACT

A process including:

mixing toners in a fluidized bed;

electrostatically loading the resulting toner mixture onto a donor roll;

ion charging the resulting layer of toner on the donor roll; and developing a latent image with the resulting charged toner layer on the donor roll member, wherein the color characteristics of the resulting developed color images encompass substantially the entire PANTONE® color space.

20 Claims, No Drawings

COLOR TONER COMPOSITIONS AND PROCESSES THEREOF

REFERENCE TO COPENDING AND ISSUED PATENTS

Attention is directed to commonly owned and assigned U.S. Pat. No. 5,723,245, to Bertrand et al., issued Mar. 3, 1998, which patent discloses a combination of toners including a cyan toner, a magenta toner, a yellow toner, an orange toner, a green toner and a black toner, each of the toners containing resin and pigment wherein the pigment for the orange toner can be Orange 5, C.I. number 12075, and the pigment for the green toner can be Green 7, C.I. number 74260, and wherein the pigment for each of the toners excluding black can be prepared by flushing processes; U.S. Pat. No. 5,712,068, to Dalal, et al., issued Jan. 27, 1998, which patent discloses toners comprised of a cyan toner, a magenta toner, a yellow toner, a green toner, and a black toner, each of the toners being comprised of resin and pigment; and wherein the pigment for the green toner is Green 7, C.I. Number 74260, or Green 36, C.I. Number 74265, and wherein the pigment, excluding black, is dispersed in the resin by flushing, wherein a cyan, magenta, green, and yellow pigment water wet cake is mixed with toner resin, and the water is substantially removed to generate pigmented resin.

Attention is directed to commonly owned and assigned copending applications U.S. Ser. No. 08/036,731 now U.S. Pat. No. 5,899,608, filed Mar. 9, 1998, entitled "Ion Charging Development System to Deliver Toner with Low Adhesion"; U.S. Ser. No. 09/178,172, filed Oct. 23, 1998, entitled "Color Toner Compositions and Processes Thereof"; and U.S. Ser. No. 09/178,147, filed Oct. 23, 1998, entitled "Color Liquid Developers and Processes Thereof."

The disclosures of each the above mentioned patents and copending applications are incorporated herein by reference in their entirety. The appropriate components and processes of these patents may be selected for the toners and processes of the present invention in embodiments thereof.

BACKGROUND OF THE INVENTION

The present invention is generally directed to high fidelity color toner compositions and processes thereof. More specifically, the present invention is directed processes from forming a vast number of different colors and developed images therefrom from a limited set or select group of toner compositions. The developed color images can embody substantially all the PANTONE color space.

Problems associated with blended toners include: potential for charge separation and or differential development, leading to changes in color fidelity with time; and non-uniform, grainy appearances with certain combinations of colors arising from poor flow, and excessive toner particle adhesion and charging of dissimilar toners. The aforementioned problems are unsatisfactory for color applications.

In embodiments of the present invention there are provided high quality color gamut processes wherein the color gamut refers to a range of colors that an imaging system can generate. One way of quantifying the color gamut is by the number of PANTONE® colors that the imaging device can produce. For example, there are about 1,000 standard PANTONE® colors used in the graphic arts industry and about half of them can be produced by a typical four-color printing process, and the remainder are outside of the four-color gamut. The process of the present invention in embodiments thereof involves all possible combinations of a selected set of colored toners including a colorless or white toner, for example, a mixture of up to about 9 different color toners, to achieve substantially the entire PANTONE® color space.

The compositions and development processes of the present invention are useful in many electrostatographic applications, for example, in xerographic printers and copiers, and especially in xerographic systems employing hybrid ion charging development systems, for example, wherein electrostatic charging of toner particles is used to load a donor roll and wherein ion charging is used to charge the resulting layer of toner particles loaded on the donor roll.

Charged particle adhesion is a major limiting factor in development with dry powder. The adhesion of the charged toner depends on the method used to charge the particles. Triboelectric charging is known to produce highly adhering particles. In contrast, ion toner charging occurs when toner particles capture ions emitted by a nearby corona device and result in a more uniform deposition of charge on the particle's surface, and thus lower the adhesion of the particles for a given charge level.

It is well known that fluidizing reservoirs, commonly referred to as fluidized beds, provide a means for storing, mixing and transporting toner in certain single component development systems. Efficient means for fluidizing toner and charging the particles within the fluidized bed are disclosed in, for example, U.S. Pat. Nos. 4,777,106 and 5,532,100, which patents are incorporated herein by reference in their entirety. In these disclosures, corona devices are embedded in the fluidized toner for simultaneous toner charging and deposition onto a receiver roll. While those development systems are satisfactory in some development applications, they are unsatisfactory in applications requiring the blending of two or more dry powder toners to achieve, for example, custom color development. In the above systems there are also frequently disturbances to the flow in the fluidized bed associated with charged particles in the high electric fields surrounding corona devices immersed in the reservoir. Finally, it is known that residual toner left on the donor roll after development contributes to nonuniformities in subsequently loaded toner layers, thereby leading to the so-called "ghosting" defect in printed images.

These and other problems are solved in embodiments of the present invention and as illustrated herein.

PRIOR ART

In European Patent Application publication, EP 0 620 505 A1, to Moore Business Forms, Inc., there is disclosed an imaging method of applying non-primary color print to a substrate comprising the steps of: a) making at least first and second differently colored toner powders having substantially uniform physical characteristics; b) introducing the first and second toner powders in desired proportions into a fluidized bed; c) uniformly mixing the first and second toner powders together in the fluidized bed; d) applying a substantially uniform electrostatic charge to the toner powders in the fluidized bed; and e) applying the electrostatically charged mixture of toner powders to a substrate to image uniform non-primary color symbols on the substrate.

U.S. Pat. No. 5,713,062, to Goodman et al., issued Jan. 27, 1998, discloses a system and method for color mixing control in an electrostatographic printing system. An operative mixture of colored developing material is continuously replenished with selectively variable amounts of developing materials of basic color components making up the operative mixture. The rate of replenishment of various color components added to the operative mixture is controlled to provide a mixture of developing material capable of producing a customer selectable color on an output copy substrate. A calorimeter is provided for monitoring the color of a test image printed with the operative mixture of developing material in the supply reservoir so that the color thereof can be brought into agreement with a color required to produce the customer selectable output color. The present invention can be used to control and maintain the color of the operational mixture of developing material in the reservoir through continuous monitoring and correction in order to maintain a specified ratio of color components in the reservoir over extended periods associated with very long print runs. The invention may also be utilized to mix a customer selectable color in situ, whereby approximate amounts of primary color components are initially deposited and mixed in the developing material reservoir and resultant images printed with the developing material mixture are continually monitored and adjusted until the mixture reaches a desired color output.

U.S. Pat. No. 5,557,393, to Goodman et al., issued Sep. 17, 1996, discloses a process and apparatus for achieving customer selectable colors in an electrostatographic imaging system which includes forming an electrostatic latent image on an image forming device, developing the electrostatic latent image on the image forming device with at least one developer containing carrier particles and a blend of two or more compatible toner compositions, and transferring the toner image to a receiving substrate and fixing it thereto. Among the compatible toner compositions that may be selected are toner compositions having blend compatibility components coated on an external surface of the toner particles and particulate toner compositions containing therein blend compatibility components or passivated pigments. Electrostatographic imaging devices, including a tri-level imaging device and a hybrid scavengeless development imaging device, are also provided for carrying out the described process. The processes and apparatus of the invention are especially useful in imaging processes for producing single color or highlight color images using customer selectable colors, or for adding highlight color to a process color image produced by the same apparatus.

U.S. Pat. No. 5,204,208, to Paine et al., issued Apr. 20, 1993, discloses a process for obtaining custom color toner compositions which comprises admixing at least two encapsulated toners wherein each toner is comprised of a core comprised of a polymer binder, pigment, dye, or mixtures thereof, and a polymeric shell; and wherein the pigment, dye, or mixtures thereof is different for each toner, thereby resulting in a toner with a color different than each of the encapsulated toners.

Other patents interest for color toner preparation and imaging include U.S. Pat. Nos. 5,392,456, and 5,688,626.

The aforementioned references are incorporated in their entirety by reference herein.

SUMMARY OF THE INVENTION

Embodiments of the present invention, include:

A process comprising:

mixing toners in a fluidized bed;

electrostatically loading the resulting toner mixture onto a donor roll;

ion charging the resulting layer of toner on the donor roll; and developing latent images with the resulting uniformly charged toner layer on a donor roll to produce high fidelity color images and which images possess color properties which embody substantially the entire PANTONE® color space; and A printing machine comprising:

a developer housing adapted for pneumatically fluidizing a mixture of colored toners therein;

a donor roll member for receiving a homogenous and uniformly charged mixture of toner particles from the developer housing and thereafter forming a layer of uniform thickness of fluidized toner mixture thereover;

an ion charging member for charging the layer of uniform thickness of toner mixture on the donor roll; and an imaging member for selectively accepting the charged toner layer of uniform thickness from the donor member to form expanded gamut color toner images.

These and other embodiments are illustrated herein.

DETAILED DESCRIPTION OF THE INVENTION

In the aforementioned commonly owned and assigned copending application U.S. Ser. No. 08/036,731 now U.S. Pat. No. 5,899,608, the disclosure of which is incorporated herein by reference in its entirety, there is disclosed an apparatus for developing a latent image recorded on an imaging surface, comprising:

a housing defining a reservoir storing a supply of developer material comprising toner;

means for fluidizing the developer material in the chamber of the housing;

a donor member, mounted partially in the chamber and spaced from the imaging surface, for transporting toner on an outer surface of the donor member to a region opposed from the imaging surface, the toner donor member having a plurality of electrodes positioned near the outer surface of donor member;

means for electrical biasing a portion of the electrode members on a region of the donor member positioned in close proximity to the fluidized toner so as to electrostatically load toner onto the region of the donor member;

means for ion charging the toner loaded on the region of the donor member;

means for electrical biasing the electrode members positioned in close proximity to the imaging member to detach toner from the region of the donor member as to form a toner cloud for developing the latent image; and means for discharging and removing residual toner on the region of the donor and returning the toner to the reservoir.

The aforementioned apparatus and development process enables a gentle toner handling system in which non-contact metering and particle charging on an electroded donor roll can be controlled independently to provide charged toner particles with low adhesion for xerographic development. The toner is initially extracted electrostatically from a fluidized bed and deposited as a net neutral layer on a donor member. This toner layer is subsequently charged with a DC or AC corona device and delivered to a latent image. This so-called ion charging produces a more uniform deposition of charge on the toner particles and results in significantly lowered particle adhesion. In addition, the ion charging process is believed to be independent of the identity of the toner pigment, allowing mixtures of two of more different colored toners to be charged homogeneously. Residual toner on the donor is neutralized and returned to the fluidized bed toner reservoir during each complete cycle of the donor roll.

Thus, for example, interdigitated electrodes on a donor roll enable uncharged toner to be picked up from a fluidized bed reservoir to form a layer of toner on the donor roll. The layer of toner is subsequently charged by exposure to a corona device and delivered to a development zone, where it is used to develop an electrostatic latent image. Residual toner on the donor is neutralized by exposure to a second corona device and then stripped for return to the fluidized bed by applying an AC voltage between adjacent donor electrodes. So-called ion charging of the toner is known to cause the particles to have low adhesion, allowing development with DC fields alone. Optionally, an AC voltage can also be applied to adjacent donor electrodes in the development zone to enhance particle release. In addition to providing a means to impart adequate flow to the toner in this single component development system, the fluidized bed reservoir, in conjunction with ion charging, also provides a means for blending dry powder toners to achieve custom color development.

The aforementioned commonly owned and assigned copending application while providing a suitable apparatus it did not provide or identify specific toner compositions or combinations, nor methods of achieving color development embodying substantially the entire PANTONE® color space as in the present invention.

Thus the present invention provides:

A process comprising:

mixing, for example, two different color toners in a fluidized bed;

electrostatically loading the resulting toner mixture onto a donor roll;

ion charging the resulting layer of toner on the donor roll; and developing a latent image with the resulting charged toner layer on the donor roll member wherein the color characteristics of the resulting developed color images can encompass substantially the entire PANTON® color space.

The resulting developed color image can be optionally transferred and optionally fixed to a receiver sheet, such as paper or transparency stock. The color space of the printed images comprises 791,000 CIELAB volume units including substantially all 972 nonmetallic and non-fluorescent PANTONE® colors. The toner mixture has a high flow characteristic in the fluid bed such that the toner particles can be fluidized to form a smooth and uniformly level surface of a toner layer on a receiver member at a sufficiently low air velocity, for example, from about 0.1 to about 5 standard cubic feet per hour (scfh) per square inch of porous bed surface, preferably from about 0.1 to about 2 scfh/in$^2$, and more preferably from about 0.2 to about 1 scfh/in$^2$. At these low air velocities typically no more than about 1 to about 5 weight percent of the toner per hour is lost due to toner entrainment in the air stream. The width of the triboelectric charge distribution arising from interparticle contact of the toner particles of the toner mixture in the fluidized bed is from about 0.05 to about 0.15 femtocoulombs per micron as measured in a charge spectrograph. The separation of the centers of the triboelectric charge distributions of the toner mixture in the fluidized bed can be less than from about 0.01 to about 0.05 femtocoulombs per micron, and the triboelectric charge distribution of individual toners in the mixture can be from about 0.05 to about 0.5 femtocoulombs per micron and preferably less than about 0.1 to about 0.25 femtocoulombs per micron. The triboelectric charge distribution of the toner particles in the toner mixture on the donor member can be from about 0.05 to about 0.5 femtocoulombs per micron, and preferably less than 0.25 femtocoulombs per micron, thereby providing uniformly charged toner layers and uniformly developed images.

A toner mixture comprises toners and mixtures thereof selected from the set of: a yellow toner; an orange toner; a magenta toner; a purple toner; a blue toner; a cyan toner; a green toner; a black toner; and a colorless toner. The yellow toner pigment can be Pigment Yellow 17; the orange toner pigment can be Pigment Orange 13; the magenta toner pigment can be Pigment Red 81:2; the purple pigment toner can be Pigment Violet 23; the blue toner pigment can be Pigment Blue 61; the cyan toner pigment can be Pigment Blue 15:3; the green toner pigment can be Pigment Green 7; the black toner pigment can be carbon black; and the colorless toner can be pigment free or contain a colorless pigment such as titanium oxide and the like colorless pigments. The present invention also embodies using pigments, dyes, or mixtures thereof, that possess equivalent or substantially similar colorant properties afforded by the aforementioned commercially available pigments.

The present invention includes printing color images comprised of a single color toner from the aforementioned color toner set thereby enabling color printing processes with color gamut expansion encompassing substantially the entire Pantone color space.

In embodiments from 2 to about 9 toners can be mixed together in individual amounts of from about 0.1 to about 99.9 weight percent based on the total weight of toner mixture. The toner mixture is substantially free of physical separation or charge separation of constituent toner particles of the toner mixture after electrostatically or ionically charging the toner mixture residing in the fluid bed or on the donor member.

Mixing toners in the fluidized bed generates charged toners with an average charge level in the bed of from about 0.05 to about 0.1 femtocoulombs per micron and preferably below about 0.1 femtocoulombs per micron as measured in a charge spectrograph. The electrostatic loading of the charged toners onto the donor roll is substantially quantitative. Similarly, ion charging of the resulting layer of toner on the donor roll is substantially quantitative and can be accomplished with conventional ionographic charging devices. The toners comprise a resin, a pigment, and a surface flow additive. The resin can be a polyester and the surface flow additive can be a hydrophobic surface treated metal oxide, such as silica, titania, alumina, or other similar small particle size metal oxides, and mixtures thereof. The surface treatment of the metal oxide can be accomplished by conventional methods with, for example, reactive hydrophobic silanes or similar compounds, or physical adsorption methods. A preferred metal oxide is silica and a preferred hydrophobic surface treatment is accomplished with a reactive hydrophobic silane compound such as hexamethyl disilazane, dichlorodimethyl silane, reactive silicone oils, and mixtures thereof.

The present invention provides a printing machine comprising:

a developer housing adapted for pneumatically fluidizing a mixture colored toner therein;

a donor roll member for receiving a homogenous and uniformly charged mixture of toner particles from the developer housing and thereafter forming a uniformly thick layer of fluidized toner mixture thereover;

an ion charging member for charging the uniformly thick layer of toner mixture on the donor roll; and an imaging member with latent images thereon for selectively accepting the charged uniformly thick toner layer from the donor member to form expanded gamut color toner images. The color characteristics of the developed color toner images can encompass substantially the entire PANTONE® color space.

Mixing toners in the fluidized bed generates charged toners with an average charge level in the fluid bed of from about 0.05 to about 0.1 femtocoulombs per micron as measured in a charge spectrograph, wherein the electrostatic loading of the charged toners onto the donor roll is substantially quantitative; wherein ion charging of the resulting layer of toner on the donor roll is substantially quantitative; and wherein acceptance of charged toner by the imaging member from the donor member is substantially quantitative. Thus, the latent images on the receiver are completely developed by the toner layer from the donor roll.

The present invention is directed to the use of color toners, toner and developer compositions with certain economical, environmentally friendly pigments, and mixtures thereof, wherein an expanded gamut of developed color images with excellent resolution can be obtained. High quality dispersion of the pigments is important and can be attained either by flushing the pigment or by the use of dispersing agents during processing. In embodiments, the toners of the present invention contain flushed pigments, and wherein there is selected a wet pigment, or wet cake for each colored toner followed by heating to melt the resin or render it molten and shearing, and wherein water is removed or substantially removed from the pigment, and there is generated in embodiments a polymer phase around the pigment enabling, for example, substantial, partial passivation of the pigment. A solvent can be added to the product obtained to provide a high quality dispersion of pigment and resin, and wherein the pigment is present in an amount of from about 25 to 50, and preferably from about 30 to about 40 weight percent. Subsequently, the product obtained is mixed and diluted with a toner resin, which resin can be similar, or dissimilar than the resin mixed with the wet pigment, to provide a toner comprised of resin and pigment, and wherein in embodiments the pigment is present in an amount of from about 2 to about 20, and preferably from about 2 to about 15 weight percent based on the weight of the toner components of resin and pigment. There is provided in accordance with the present invention toners with the colored pigment dispersed to a high quality state. With the present invention, there is enabled a combination of toners with a high color gamut, especially in reflection developed images and with transparencies, and wherein with transparencies a substantial amount of scattered light and embodiments most of the scattered light is eliminated allowing, for example, about 70 to about 98 percent of the transmitted light passing through a fused image on a transparency to reach the screen from an overhead projector. The toner and developer compositions of the present invention can be selected for electrophotographic, especially known ion charging xerographic imaging and printing processes, and preferably full color processes.

Advantages of the present invention illustrated herein include excellent stable triboelectric characteristics, acceptable stable admix properties, superior color resolution, the capability of obtaining virtually any color desired, that is a full color gamut, for example, thousands of different colors and different developed color images, substantial toner insensitivity to relative humidity, toners that are not substantially adversely affected by environmental changes of temperature, humidity, and the like, the provision of separate toners, such as a yellow toner; an orange toner; a magenta toner; a purple toner; a blue toner; a cyan toner; a green toner; a black toner; and a colorless toner, and mixtures thereof with the advantages illustrated herein, and which toners can be selected for the spot and multicolor development of electrostatic images. The specific selection of colored toners together with exceptionally well dispersed pigments provides, for example, a smooth fused image surface and enables a large color gamut which assures that thousands of colors can be produced. The toner compositions of the present invention usually contain surface additives and may also contain charge additives, waxes, such as polypropylene, polyhydroxy compounds, or polymeric alcohols, such as the UNILINS®, reference U.S. Pat. No. 4,883,736, the disclosure of which is totally incorporated herein by reference, and which UNILINS® are available from Petrolite Chemicals. The aforementioned alcohols are in embodiments of the present invention are selected as components for dispersing the pigments.

Combination or set refers, in embodiments of the present invention, to separate toners that are not mixed together, rather each toner exists as a separate composition in a toner reservoir or supply container and the separate toners are subsequently mixed together in a common developer housing to achieve a blend or intimate homogenous mixture of different color toner particles, and optionally containing carrier particles to achieve two component development processes, such as in the Xerox Corporation Model 5775. For example, a yellow toner is present in one toner supply housing, an orange toner is present in a second separate toner supply housing, a magenta toner is present in a third separate toner supply housing, and so forth. The individual toners are controllably dispensed in to a common developer housing, with or without carrier particles present, and wherein the carrier particles are, for example, typically comprised of a metallic core with a coating thereover.

Toners with certain colored pigments are illustrated in U.S. Pat. No. 5,262,264, the disclosure of which is totally incorporated herein by reference.

Developer compositions with charge enhancing additives, which impart a positive charge to the toner resin, are also known. Thus, for example, there is described in U.S. Pat. No. 3,893,935 the use of quaternary ammonium salts as charge control agents for electrostatic toner compositions; U.S. Pat. No. 4,221,858 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens, such as iodide, chloride and bromide; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Further, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Moreover, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other patents disclosing positively charged toner compositions with charge control additives include U.S. Pat. Nos. 3,944,493; 4,007,293; 4,079,014; 4,394,430 and 4,560,635 which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives. Further, of interest are U.S. Pat. Nos. 5,262,264 and 5,437,949, the disclosures of which are totally incorporated herein by reference.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLES

Preparation of Toners and Toner Blends

Toners in Table 1 were prepared by mixing, for example, melt mixing in an extruder, from about 2 to about 5 weight percent of individual pigments with a polyester resin and then jetting the resulting mixture to approximately 7 microns diameter. Next about 1 weight percent Cabosil TS530 silica was then ball mill blended for 30 minutes with each of the toners to provide the proper flow properties.

TABLE 1

| Compatible Toners | | |
|---|---|---|
| Toner | Color | Pigment |
| 1 | Yellow | PY 17 |
| 2 | Orange | PO 13 |
| 3 | Rhodamine Red | PR 81:2 |
| 4 | Violet | PV 23 |
| 5 | Reflex Blue | PB 61 |
| 6 | Process Blue | PB 15:3 |
| 7 | Green | PG 7 |
| 8 | White | None |
| 9 | Black | Regal 330 |

The resultant individual toners were then physically blended or mixed in all possible toner-toner combinations, for example, from 2 to about 9 different toners, such as in a wiggle-bug or a fluidized bed apparatus. Typically the toners were mixed in a one-to-one ratio. However, the black toner was typically used at a 1 to 4 weight ratio in combination with one or more colored or uncolored toners, and is consistent with the way that black is blended in the Pantone mixing guidebook. A one-to-one ratio of black with most colors generally appears too dark. The set of pigments and their corresponding toners, in the appropriate predetermined ratios, can generate substantially the entire Pantone color space or gamut as disclosed in copending application U.S. Ser. No. 09/178,172, filed Oct. 23 1998, the disclosure of which incorporated by reference herein in its entirety.

Fluidized Bed for Mixing Toners

A small fluid bed was constructed from a tube of sintered stainless steel as follows. The tube was cut in half lengthwise, and then plastic sheets were glued to the ends of one half to form a trough. The pore size of the sintered stainless was about 2 microns, and the diameter of the trough was 1.9 cm. The length of the trough was about 5.3 cm. Additional plastic sheets were glued beneath the trough to form an air chamber or manifold; a gas coupling was added to the chamber to permit the introduction of compressed air into the chamber. Compressed air passes through the sintered steel of the trough and then passes through toner residing in the trough. As an example, one half gram (0.5 gm) of two different toners was then placed in the bed and fluidized for about 10 minutes by feeding 3.5 standard cubic feet per hour (scfh) of compressed air through the fluidized bed housing chamber. Although not wanting to be limited by theory, the flow rate of about 2 scfh/in$^2$ is believed to be near the high end of the useful air flow range based upon consideration of the inefficiency and geometry of the small scale prototype fluid bed. Larger scale beds can achieve adequate fluidizing air flows with similar materials of construction and toner development at lower air flow rates, for example, about 0.5 scfh/in$^2$.

Toner Blending and Blended Toner Properties

All combinations of the pigmented toners of Table 1 blended well in the fluid bed and showed no charge separation using the spatula test: a spatula dipped into the fluid bed containing fluidized toner and then toner adhering to the spatula was blown off the spatula and into a charge spectrograph. Typical measured widths of the blended toners were from about 0.05 to about 0.15 femtocoulombs per micron (fc/$\mu$). An electroded grid with 1 millimeter wide electrodes 1 millimeter apart with 20 volts difference between alternating electrodes was lowered into the fluid bed for many of the examples of toner combinations of the compatible set. None of these blends showed any sign of color separation on the electroded grid.

COMPARATIVE EXAMPLES

Evaluation and Identification of Incompatible Toners

Table 2 contains exemplary incompatible toners which incompatibility was determined empirically in accordance with the above blending procedures for compatible toners of Table 1 in Example 1. The combination of Warm Red (Pigment Red 53:1) and Green (Pigment Green 7) pigmented toners was discovered to exhibit separation problems in the fluid bed, for example, red toner appeared on each side of the green upon fluidization. Thus the Warm Red toner(No. 10) is apparently incompatible with the Green toner. In the present invention a green toner is needed to generate the full Pantone gamut whereas the Warm Red is not needed.

The combination of Rubine Red (Pigment Red 57:1) and Green (Pigment Green 7) pigmented toners showed a more pronounced separation problems. The red toner(No. 11) had a width of about 0.25 fc/$\mu$ and extended on both sides of the Green, which has a width of about 0.05 fc/$\mu$. Also, the center of the green was displaced about 0.025 fc/$\mu$ from zero toward negative charge, and the center of the red was displaced about 0.025 fc/$\mu$ toward positive charge. Thus the separation of the centers of the red and green distributions was about 0.05 fc/$\mu$. When the electroded grid is placed in the bed with this pair of toners, some separation of colors was seen on the grid. Thus separation for uniform donor loading should be below about 0.05 fc/$\mu$. However, as noted above for Warm Red, toners made with the Rubine Red pigment are similarly not required to generate the full Pantone color set.

TABLE 2

| Toners Incompatible with Green | | |
|---|---|---|
| Toner No. | Color | Pigment |
| 10 | Warm Red | PR 53:1 |
| 11 | Rubine Red | PR 57:1 |

Other modifications of the present invention may occur to one of ordinary skill in the art based upon a review of the present application and these modifications, including equivalents thereof, are intended to be included within the scope of the present invention.

What is claimed is:

1. A process comprising:

mixing toners in a fluidized bed;

electrostatically loading the resulting toner mixture onto a donor roll;

ion charging the resulting layer of toner on the donor roll; and developing a latent image with the resulting charged toner layer on the donor roll member, wherein the color characteristics of the resulting developed color images encompass substantially all spot colors used in printing, wherein the toners are selected from the group consisting of a yellow toner; an orange toner; a magenta toner; a purple toner; a blue toner; a cyan toner; a green toner; a black toner; and a colorless toner.

2. A process in accordance with claim 1, further comprising optionally transferring and optionally fixing the developed color image to a receiver sheet.

3. A process in accordance with claim 1, wherein the toner mixture has a high flow characteristic in the fluid bed such that the toner particles can be fluidized to form a smooth and uniformly level surface of a toner layer on the donor roll at a sufficiently low air velocity of from about 0.1 to about 5 scfh/in$^2$ of porous bed surface so that not more than about 1 to about 5 weight percent of the toner per hour is lost due to toner entrainment in the air stream.

4. A process in accordance with claim 1, wherein the width of the triboelectric charge distribution arising from interparticle contact of the toner particles in the toner mixture is from about 0.05 to about 0.15 femtocoulombs per micron.

5. A process in accordance with claim 1, wherein the separation of the centers of the triboelectric charge distributions of the toner mixture in the fluidized bed is from about 0.01 to about 0.05 femtocoulombs per micron, wherein the triboelectric charge distribution of individual toners in the mixture is from about 0.05 to about 0.5 femtocoulombs per micron, and wherein the triboelectric charge distribution of the toner particles in the toner mixture is from about 0.05 to about 0.5 femtocoulombs per micron.

6. A process in accordance with claim 1, wherein from 2 to about 9 toners are mixed together in individual amounts of from about 0.1 to about 99.9 weight percent based on the total weight of toner mixture.

7. A process in accordance with claim 1, wherein the toner mixture is substantially free of physical separation or charge separation of constituent toner particles of the toner mixture after electrostatically or ionically charging the toner mixture.

8. A process in accordance with claim 1, wherein the toner mixture comprises at least two toners selected from the group consisting of: a yellow toner; an orange toner; a magenta toner; a purple toner; a blue toner; a cyan toner; a green toner; a black toner; and a colorless toner.

9. A process in accordance with claim 8, wherein the yellow toner pigment is Pigment Yellow 17; the orange toner pigment is Pigment Orange; the magenta toner pigment is Pigment Red 81:2; the purple pigment toner is Pigment Violet 23; the blue toner pigment is Pigment Blue 61; the cyan toner pigment is Pigment Blue 15:3; the green toner pigment is Pigment Green 7; the black toner pigment is carbon black; and the colorless toner is pigment free.

10. A process in accordance with claim 1, wherein mixing toners in the fluidized bed housing generates charged toners with an average charge level in the bed of from about 0.05 to about 0.1 femtocoulombs per micron.

11. A process in accordance with claim 1, wherein the electrostatic loading of the charged toners onto the donor roll is substantially quantitative.

12. A process in accordance with claim 1, wherein ion charging of the resulting layer of toner on the donor roll is substantially quantitative.

13. A process in accordance with claim 1, wherein the toner particles of the toner mixture comprise a resin, a pigment, and a surface flow additive.

14. A process in accordance with claim 13, wherein the resin comprises a polyester and wherein the surface flow additive comprises a hydrophobic surface treated metal oxide.

15. A process in accordance with claim 13, wherein the metal oxide is selected from the group consisting of silica, titania, alumina, and mixtures thereof, and wherein the surface treatment of the metal oxide is accomplished with a reactive hydrophobic silane.

16. A process in accordance with claim 15, wherein the metal oxide is silica and wherein the hydrophobic surface treatment with a reactive hydrophobic silane compound is accomplished with a compound selected from the group consisting of hexamethyl disilazane, dichlorodimethyl silane, silicone oil, and mixtures thereof.

17. A printing machine comprising:

a developer housing adapted for pneumatically fluidizing a mixture of colored toners therein;

a donor roll member for receiving a homogenous and uniformly charged mixture of toner particles from the developer housing and thereafter forming a layer of uniform thickness of fluidized toner mixture thereover;

an ion charging member for charging the layer of uniform thickness of toner mixture on the donor roll; and an imaging member for selectively accepting the charged toner layer of uniform thickness from the donor member to form expanded gamut color toner images, wherein the toners are selected from the group consisting of a yellow toner; an orange toner; a magenta toner: a purple toner; a blue toner; a cyan toner; a green toner; a black toner; and a colorless toner.

18. A printing machine in accordance with claim 17, wherein the color toners mixture comprises two or more toners selected from the group consisting of: a yellow toner;

an orange toner; a magenta toner; a purple toner; a blue toner; a cyan toner; a green toner; a black toner; and a colorless toner.

19. A printing machine in accordance with claim 17, wherein mixing toners in the fluidized bed housing generates charged toners with an average charge level in the fluid bed of from about 0.05 to about 0.1 femtocoulombs per micron, wherein the electrostatic loading of the charged toners onto the donor roll is substantially quantitative, wherein ion charging of the resulting layer of toner on the donor roll is substantially quantitative, and wherein acceptance of charged toner by the imaging member from the donor member is substantially quantitative.

20. A printing machine in accordance with claim 17, wherein the color characteristics of the toner images encompass substantially all spot colors used in printing.

* * * * *